US012139828B2

(12) United States Patent
Lawrence

(10) Patent No.: US 12,139,828 B2
(45) Date of Patent: Nov. 12, 2024

(54) WET-ACTIVATED COOLING FABRIC

(71) Applicant: MPUSA, LLC, Fort Lauderdale, FL (US)

(72) Inventor: David Chad Lawrence, Alpharetta, GA (US)

(73) Assignee: MPUSA, LLC, Fort Lauderdale, FL (US)

( * ) Notice: Subject to any disclaimer, the term of this patent is extended or adjusted under 35 U.S.C. 154(b) by 0 days.

(21) Appl. No.: 18/123,396

(22) Filed: Mar. 20, 2023

(65) Prior Publication Data

US 2024/0044056 A1 Feb. 8, 2024

Related U.S. Application Data

(63) Continuation of application No. 17/329,464, filed on May 25, 2021, now Pat. No. 11,639,567, which is a continuation-in-part of application No. 16/100,939, filed on Aug. 10, 2018, now Pat. No. 11,015,271, which is a continuation of application No. PCT/US2017/035734, filed on Jun. 2, 2017.

(60) Provisional application No. 62/345,321, filed on Jun. 3, 2016.

(51) Int. Cl.
*D04B 21/16* (2006.01)

(52) U.S. Cl.
CPC ..... *D04B 21/16* (2013.01); *D10B 2401/021* (2013.01); *D10B 2401/22* (2013.01); *D10B 2403/0114* (2013.01); *D10B 2501/04* (2013.01)

(58) Field of Classification Search
CPC ..... D04B 23/22; D04B 21/18; D04B 21/08; D04B 21/16; D04B 21/06
See application file for complete search history.

(56) References Cited

U.S. PATENT DOCUMENTS

| | | | |
|---|---|---|---|
| 3,922,888 | A | 12/1975 | Patterson |
| 3,952,555 | A | 4/1976 | Lesley |
| 4,341,096 | A | 7/1982 | Safrit et al. |
| 4,530,873 | A | 7/1985 | Okada |
| 4,638,648 | A | 1/1987 | Gajjar |
| 4,688,403 | A | 8/1987 | Gajjar |

(Continued)

FOREIGN PATENT DOCUMENTS

| | | | |
|---|---|---|---|
| JP | 11984004789 | U | 1/1984 |
| JP | 2003-113562 | A | 4/2003 |

(Continued)

OTHER PUBLICATIONS

International Search Report and Written Opinion dated Nov. 27, 2017, from International Application No. PCT/US2017/035734, 16 sheets.

(Continued)

*Primary Examiner* — Danny Worrell

(74) *Attorney, Agent, or Firm* — Carter, DeLuca & Farrell LLP

(57) ABSTRACT

Disclosed herein is a knitted multi-layer fabric construction that provides the ability to cool skin to below a current temperature whether wetted or dry. The knit uses four separate yarns which collectively work together to produce enhanced cooling. Knits can include warp knit, seamless, hosiery, flat bed, spacer, and double knits. Various finishing methods may also be employed to enhance the cooling power of the fabric.

20 Claims, 9 Drawing Sheets

(56) References Cited

U.S. PATENT DOCUMENTS

| | | | | |
|---|---|---|---|---|
| 5,029,457 | A | 7/1991 | Gajjar | |
| 5,065,600 | A | 11/1991 | Byles | |
| 5,217,782 | A | 6/1993 | Moretz | |
| 5,312,667 | A | 5/1994 | Lumb | |
| 5,596,888 | A | 1/1997 | McLarty, III | |
| 5,735,145 | A | 4/1998 | Pernick | |
| 5,899,095 | A | 5/1999 | Spillane | |
| 6,151,928 | A | 11/2000 | Anyon | |
| 6,745,601 | B2 | 6/2004 | Pierelli | |
| 6,770,581 | B1 | 8/2004 | DeMott | |
| 6,986,270 | B2 | 1/2006 | Miller, III | |
| 7,360,378 | B2 | 4/2008 | Foshee | |
| 7,390,254 | B2 | 6/2008 | Yoshiaki | |
| 7,465,683 | B2 | 12/2008 | McMurray | |
| 8,088,698 | B2 | 1/2012 | Polegato Moretti | |
| 8,334,134 | B2 | 12/2012 | Young | |
| 9,506,187 | B2 | 11/2016 | Minko | |
| 9,725,835 | B2 | 8/2017 | Vaglio Tessitore | |
| 9,828,705 | B1 | 11/2017 | Shiue | |
| 10,428,448 | B2 | 10/2019 | Lawrence | |
| 10,584,432 | B2 | 3/2020 | Akita | |
| 11,015,271 | B2 | 5/2021 | Lawrence | |
| 11,639,567 | B2 * | 5/2023 | Lawrence | D04B 21/16 66/196 |
| 2003/0051512 | A1 | 3/2003 | Pierelli | |
| 2007/0163305 | A1 | 7/2007 | Baer | |
| 2008/0072629 | A1 | 3/2008 | Gehring | |
| 2011/0262951 | A1 | 10/2011 | Young | |
| 2012/0177904 | A1 | 7/2012 | Gehring, Jr. | |
| 2013/0196363 | A1 | 8/2013 | Young | |
| 2013/0237109 | A1 | 9/2013 | Ackroyd | |
| 2014/0298562 | A1 | 10/2014 | Luscher | |
| 2015/0240415 | A1 | 8/2015 | Haggquist | |
| 2017/0107649 | A1 | 4/2017 | Lonati | |
| 2018/0347084 | A1 | 12/2018 | Lawrence | |
| 2020/0385901 | A1 | 12/2020 | Lawrence | |

FOREIGN PATENT DOCUMENTS

| | | | |
|---|---|---|---|
| JP | 2003-293250 | A | 10/2003 |
| JP | 4-057945 | B2 | 3/2008 |
| JP | 3174889 | U | 4/2012 |
| JP | 2013249560 | A | 12/2013 |
| JP | 2014141759 | A | 8/2014 |
| KR | 10-0403199 | B1 | 10/2003 |
| KR | 1020020060878 | | 10/2003 |
| KR | 10-1556411 | B1 | 9/2015 |
| WO | 2021/011373 | A1 | 1/2021 |

OTHER PUBLICATIONS

International Written Opinion of International Preliminary Examining Authority dated Jul. 23, 2018, from International Application No. PCT/US2017/035734, 9 sheets.

Notification of Reasons for Refusal dated Mar. 3, 2020 for Japanese Patent Application No. 2018-562524.

Office Action dated Jun. 12, 2019, from corresponding U.S. Appl. No. 16/077,353, 12 sheets.

International Search Report and Written Opinion issued in corresponding International Application No. PCT/US22/30879, dated Sep. 8, 2022, pp. 1-12.

Notification of Reasons for Refusal dated Jan. 25, 2022 for Japanese Patent Application No. 2020-204050.

Notification of Reasons for Refusal dated Jun. 28, 2022 for Japanese Patent Application No. 2020-204050.

International Report on Patentability issued in corresponding International Application No. PCT/US2022/030879, dated Nov. 21, 2023, pp. 1-5.

* cited by examiner

BAR1
1-0 / 2-3

BAR2
1-2 / 1-0

BAR3
0-1 / 2-1

BAR4
1-0 / 1-2

SEAMLESS KNIT FACE

SEAMLESS KNIT BACK

WET-ACTIVATED COOLING FABRIC

CROSS-REFERENCE TO RELATED APPLICATION

The present application is a continuation of U.S. patent application Ser. No. 17/329,464, filed on May 25, 2021, which is a continuation-in-part of U.S. patent application Ser. No. 16/100,939, filed on Aug. 10, 2018, which is a continuation application of International Application No.: PCT/US2017/035734, filed Jun. 2, 2017, the entire contents of which are hereby incorporated by reference in their entirety, and which claims priority to, and the benefit of, U.S. Provisional Patent Application Ser. No. 62/345,321, filed Jun. 3, 2016, the entire contents of which are hereby incorporated by reference in their entirety.

BACKGROUND

(1) Field of Invention

The present invention relates generally to textile fabrics and, more particularly, to multi-layer knitted fabric constructions that provide the ability to cool skin below a current temperature of the skin for a longer duration primarily when wetted but secondarily in a dry state.

(2) Description of Prior Art

Previous wet-activated cooling fabrics have used woven and double knit constructions using absorbent yarns which have moisture absorbing properties. A first layer, located next to the skin, provides a sustained cooling effect. However, such fabrics generally quickly dry out and/or warm up to the skin temperature of the user, negating any cooling effect. Therefore, a need exists for a multi-layer cooling fabric employing more advanced yarns and construction techniques which can provide a sustained cooling effect for a greater amount of time.

SUMMARY OF THE INVENTION

The present invention relates generally to textile fabrics and, more particularly, to multi-layer knitted fabric constructions that provide the ability to cool skin below a current temperature of the skin for a longer duration, primarily when wetted, but secondarily in a dry state.

DETAILED DESCRIPTION

Warp Knit Construction

Figure 1:
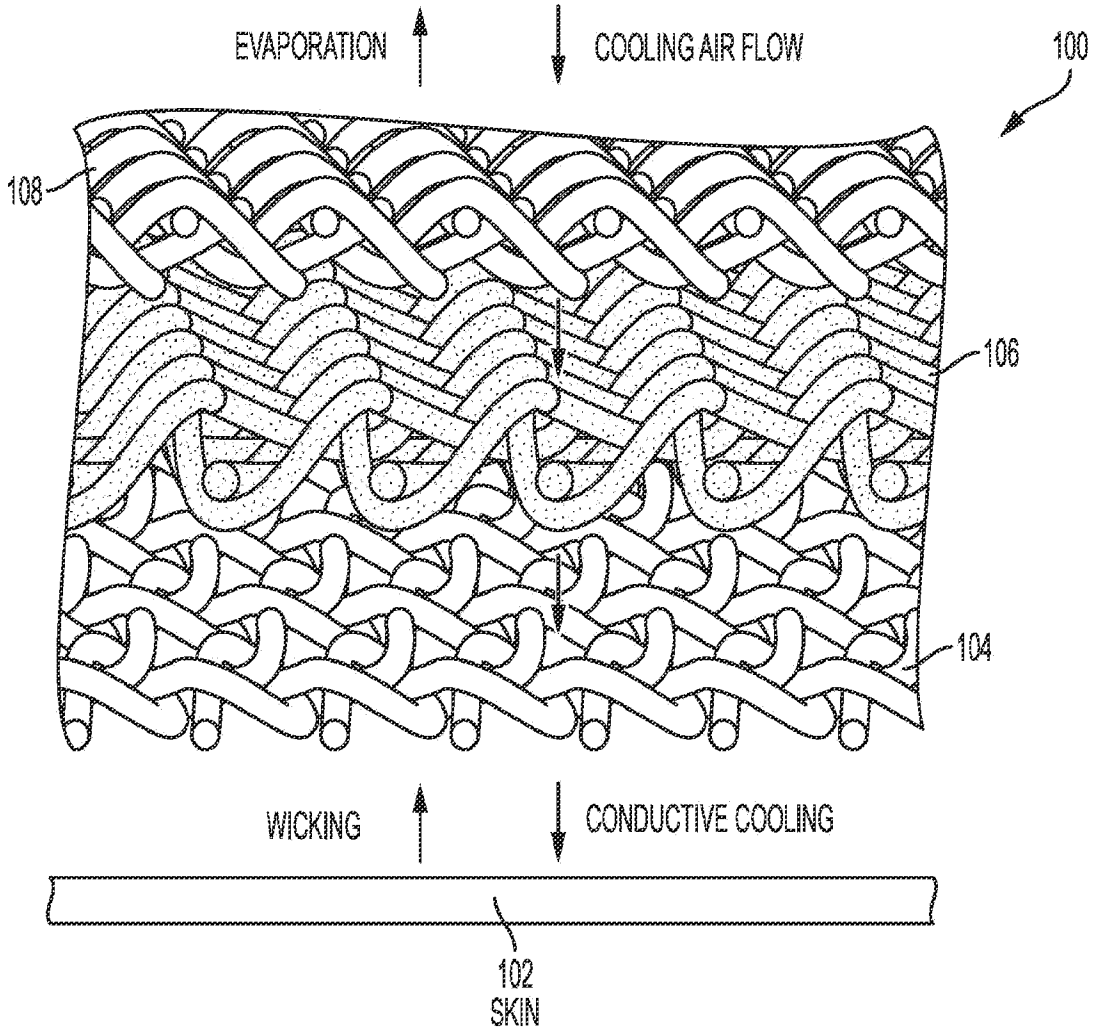
FIG. 1 depicts a representational cross-sectional view of the cooling fabric showing the different layers of the fabric.

As shown in FIG. 1, an embodiment of the cooling fabric 100 is intended to be worn next to the skin 102 of a user, such as an athlete. The cooling fabric 100 may form an entire garment, such as a shirt or a pair of shorts, or be strategically integrated into garments where extra cooling is needed, such as near the shoulders/underarms of a user. The cooling fabric 100 may also be utilized to form standalone cooling products such as headbands, towels, hats, etc.

The layers of cooling fabric 100 depicted in FIG. 1 in cross-section are shown separated for clarity and illustrative purposes. In the actual manufactured fabric, the different layers 104-108 are interconnected in a knit construction that is described with reference to FIGS. 3A-3E, for example.

Figure 2A:
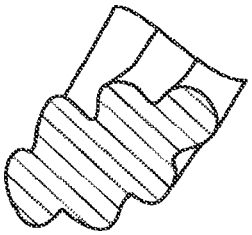
FIGS. 2A-2D depict cross sectional views of yarn filaments used in construction of the cooling fabric.

A first layer 104 of the cooling fabric 100, to be warn against the skin 102, is preferably formed of a combination of a stretchable synthetic yarn and an evaporative yarn. Suitable stretchable synthetic yarns include, but are not limited to, spandex, lycra or elastane. Preferably, spandex is used in the construction of cooling fabric 100. A cross-section of a single filament of a stretchable synthetic yarn, such as spandex, is depicted in FIG. 2D. However, the spandex may be omitted from first layer 104 if stretch or draping qualities are not needed for cooling fabric 100.

The evaporative yarn of first layer 104, together with the spandex, creates hydrophobic and hydrophilic channels for perspiration to enter the absorbent center of cooling fabric 100 while also allowing the chilled (e.g., 60° F.) center to provide conductive cooling against skin 102 (e.g., at an average skin temperature of 93.2° F.) as shown by the arrows near skin 102. The evaporative yarn of first layer 104 is preferably a nylon or polyester yarn having a unique cross-section (as seen in FIG. 2A) and is embedded with minerals (e.g., jade or mica) to transport and evaporate moisture from skin 102 while still providing conductive cooling from center layer 106 while also a cooling touch from layer 104. Examples of suitable evaporative yarns include AQUA-X and ASKIN, both manufactured by Hyosung Corporation of the Republic of Korea, both of which also provide UV protection.

The second layer 106 of cooling fabric 100 is formed from a highly absorbent yarn designed to absorb and hold moisture that is wicked from skin 102 by first layer 104. The high absorbance of the second layer 106 is also important to provide a cooling effect to skin 102. That is, because the second layer 106 is highly absorbent, it is able to retain a greater quantity of cooled water when wetted while still providing the ability to absorb wicked moisture.

Figure 2B:
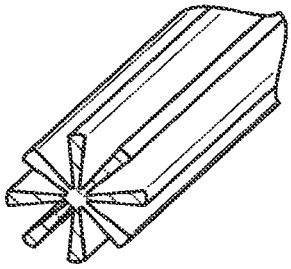

Second layer 106 is preferably formed from a conjugated bi-component polyester and nylon yarn with a special star-shaped cross-section (the star-shaped cross-section is formed as the result of a treatment applied after cooling fabric 100 is knitted) as depicted in FIG. 2B. Such a yarn is more absorbent than traditional absorbent yarns used in most cooling fabrics. An example of a yarn suitable for use in the second layer 106 is Hyosung MIPAN XF. The yarn utilized in the second layer 106 is preferably Hyosung MIPAN XF which has a wicking rate and a wicking distance more than twice that of cotton of equivalent density.

Figure 2C:
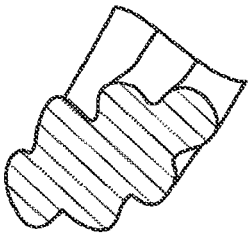
Figure 2D:
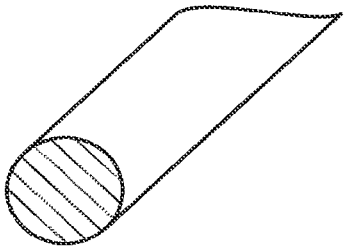

The third layer 108 of cooling fabric 100 is formed from a yarn designed to transport moisture and provide a cool touch. The third layer 108 allows the moisture trapped in second layer 106 to evaporate into the ambient air and also allows ambient air to move into second layer 106 to cool the center of cooling fabric 100. A cross-section of a single filament of a yarn suitable for use in third layer 108 is depicted in FIG. 2C.

The cooling effect for cooling fabric 100 follows the principles of evaporative cooling. This principle details that water must have heat applied to change from a liquid to a vapor. Once evaporation occurs, this heat from the liquid water is taken due to evaporation resulting in cooler liquid. Once the cooling fabric 100 is wetted with water and preferably wringed to remove excess water, snapping or twirling in the air is a recommended process as it helps facilitate and expedite the moisture movement from the second layer 106, where water is stored, to the outer evaporative layers 104 and 108, where water evaporation occurs. Snapping or twirling in the air also increases the evaporation rate and decreases the material temperature more rapidly by exposing more surface area of the material to air and increased air flow. More specifically, the cooling fabric 100 functions as a device that facilitates and expedites the evaporative process.

Once the temperature of the remaining water in the outer evaporative layer 108 drops through evaporation, a heat exchange happens within water through convection, between water and fabric through conduction, and within fabric through conduction. Thus, the temperature of cooling fabric 100 drops. The evaporation process further continues by wicking water away from the layer 106 to layers 104 and 108 until the stored water is used up. The evaporation rate decreases as the temperature of cooling fabric 100 drops. The temperature of cooling fabric 100 drops gradually to a certain point where equilibrium is reached between the rate of heat absorption into material from environment and heat release by evaporation.

Once the wetted cooling fabric 100 is placed onto one's skin, cooling energy from the cooling fabric 100 is transferred through conduction. After the cooling energy transfer has occurred, the temperature of the cooling fabric increases to equilibrate with the skin temperature. Once this occurs, the wetted cooling fabric 100 can easily be re-activated by the snapping or the twirling method to again drop the temperature.

The various views depicted in FIGS. 2A-2D are cross-sectional diagrams of a single filament used in the different yarns for layers 104-108. However, each yarn used in the present invention contains multiple filaments.

The four-yarn combination utilized in cooling fabric 100 allows for more absorption of water to occur while transporting water efficiently through cooling fabric 100 to create an evaporative cooling effect which increases the conductive cooling effect of cooling fabric 100. Further benefits of cooling fabric 100 include:

- Cool touch provided by third layer 108 (exterior) and first layer 104 (against skin 102) when the cooling fabric 100 is dry. A cool touch fabric is a fabric that physically feels cooler than the ambient air when touched by a user, whether wet or dry.
- Temperature decrease of the fabric surface by up to 30° F. below average body temperature (e.g., at 98.6° F.) when wet and activated through wringing, snapping or twirling.
- Up to a 30% increase in conductive cooling power measured in Watts/$m^2$ when compared to other fabrics such as cotton.
- Cooling for up to two hours after wetting depending on ambient air conditions.
- UV protection.

Next, with reference to FIGS. 3A-3E, the unique knitting construction of cooling fabric 100 is described which allows for four different yarns to be used in the same material. Preferably, a warp knit is used during the construction of cooling fabric 100. Warp knits include, but are not limited to, tricot, raschel, spacer, and lace.

Figure 3A:
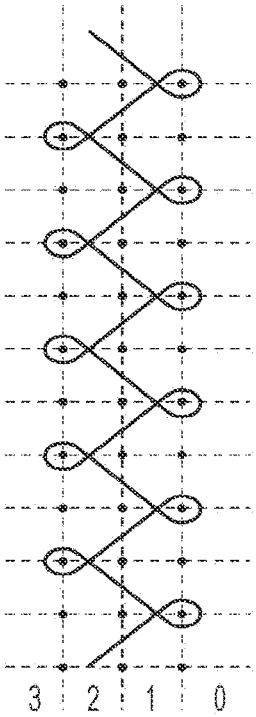
FIGS. 3A-3E depict a pattern for making a warp knit construction, showing the placement of each yarn in the cooling fabric.
Figure 3B:
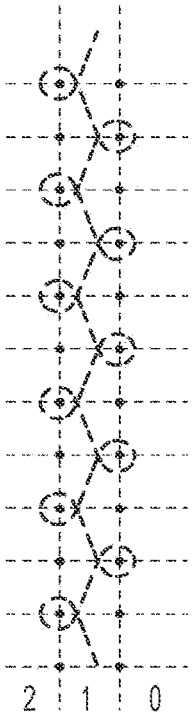
Figure 3C:
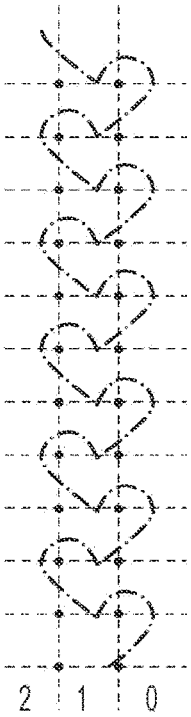
Figure 3D:
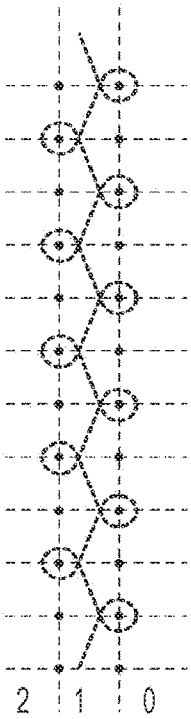

Examples of warp knit tricot 4-bar will be described herein. A first example for warp knit tricot 4-bar construction, depicted in FIGS. 3A-3E, utilizes the following stitch and yarn combinations:

- FIG. 3A—Bar 1—1-0/2-3 (evaporative yarn such as AQUA-X)
- FIG. 3B—Bar 2—1-2/1-0 (absorbent yarn such as MIPAN XF)
- FIG. 3C—Bar 3—0-1/2-1 (evaporative yarn such as ASKIN)
- FIG. 3D—Bar 4—1-0/1-2 (elastic yarn such as Spandex)

Figure 3E:
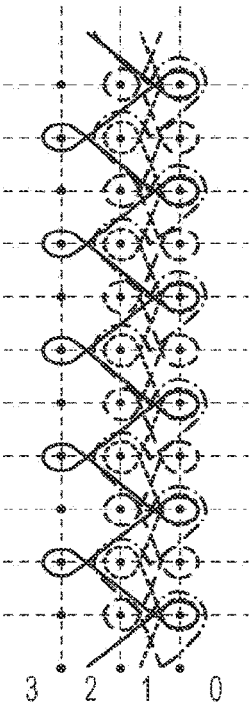

Preferably, bar 1 is a 35 Denier/24 filament nylon fully drawn yarn; bar 2 is a 50 Denier/48 filament conjugated polyester/nylon bi-component fully drawn yarn; bar 3 is a 75 Denier/36 filament polyester draw textured yarn; and bar 4 is a 40 Denier spandex. This configuration results in a fabric having a density of 100-600 g/$m^2$, but more preferably 160-400 g/$m^2$. The combined multi-layer cooling fabric 100 resulting from this stitch is depicted in FIG. 3E.

The yarn Deniers and filament counts used on bars 1-4 can be varied using the following ranges:

- Bar 1: Evaporative yarn with Denier range—10 Denier-200 Denier, Filament range—1 filament—400 filaments
- Bar 2: Absorbent yarn with Denier range—10 Denier-200 Denier, Filament range—1 filament-400 filaments
- Bar 3: Evaporative yarn with Denier range—10 Denier-200 Denier, Filament range—1 filament-400 filaments
- Bar 4: Elastomeric yarn with Denier range—10 Denier-340 Denier As another example, Bar 2 may utilize a yarn such as Nanofront polyester yarn manufactured by Teijin which has significantly smaller filaments than traditional absorbent yarns.

Another embodiment of cooling fabric 100 uses the following 4-bar knitting stitch and yarn combination:

- Bar 1—1-0/2-3 (evaporative yarn such as ASKIN)
- Bar 2—1-2/1-0 (absorbent yarn such as MIPAN XF)
- Bar 3—0-1/2-1 (evaporative yarn such as ASKIN)
- Bar 4—1-0/1-2 (elastic yarn such as Spandex)

In this stitch configuration, bar 1 is a 45 Denier/24 filament polyester fully drawn yam; bar 2 is a 50 Denier/48 filament polyester and nylon conjugated fully drawn yarn; bar 3 is a 75 Denier/36 filament polyester draw textured yarn; and bar 4 is a 40 Denier spandex.

In both knitting stitch examples, bars 1 and 3 are cool touch/quick dry/absorption materials as have already been described. The Qmax for these yarns is greater than 0.140 W/$cm^2$ on the face side and 0.120 W/$cm^2$ on the back side of the material which indicates a cooling touch effect as has already been described. The wet Qmax for these yarns is greater than 0.280 W/$cm^2$ on face side and 0.180 W/$cm^2$ on back side. Bar 2 is a conjugated highly absorbent yarn (MIPAN XF) which has a wicking rate and a wicking distance more than twice that of cotton of equivalent density. The spandex yarn provides hydrophobic properties, provides stretch properties, and a draping effect.

Another example for warp knit tricot 4-bar construction utilizes the following stitch and yarn combinations:

FIG. 3A—Bar 1—1-0/2-3 (evaporative yarn such as ASKIN)

FIG. 3B—Bar 2—1-2/1-0 (absorbent yarn such as Nylon/Polyester Conjugated Yarn)

FIG. 3C—Bar 3—0-1/2-1 (evaporative yarn such as ASKIN)

FIG. 3D—Bar 4—1-0/1-2 (elastic yarn such as Spandex)

Preferably, bar 1 is a 50 Denier/72 filament polyester draw textured yarn; bar 2 is a 75 Denier/36 filament conjugated polyester/nylon bi-component draw textured yarn; bar 3 is a 75 Denier/36 filament polyester draw textured yarn; and bar 4 is a 70 Denier spandex. This configuration results in a fabric having a density of 100-600 g/m$^2$, but more preferably 250-350 g/m$^2$. The combined multi-layer cooling fabric 100 resulting from this stitch is depicted in FIG. 3E.

The overall fiber content for this example is approximately 86% Polyester, 7% Polyamide, and 7% Elastane.

The yarn Deniers and filament counts used on bars 1-4 can be varied using the following ranges:

Bar 1: Evaporative yarn with Denier range—10 Denier-200 Denier, Filament range—1 filament-400 filaments Bar 2: Absorbent yarn with Denier range—10 Denier-200 Denier, Filament range—1 filament-400 filaments Bar 3: Evaporative yarn with Denier range—10 Denier-200 Denier, Filament range—1 filament-400 filaments Bar 4: Elastomeric yarn with Denier range—10 Denier-340 Denier Furthermore, the stitch notation for this example can vary from the above stated to the following:

Bar 1—1-0/3-4 (evaporative yarn such as ASKIN)

Bar 2—1-2/1-0 (absorbent yarn such as Nylon/Polyester Conjugated Yarn)

Bar 3—0-1/2-1 (evaporative yarn such as ASKIN)

Bar 4—1-0/1-2 (elastic yarn such as Spandex)

A further example for warp knit tricot 4-bar construction utilizes the following stitch and yarn combinations:

FIG. 3A—Bar 1-1-0/2-3 (evaporative yarn such as AQUA X)

FIG. 3B—Bar 2-1-2/1-0 (absorbent yarn such as Nylon/Polyester Conjugated Yarn)

FIG. 3C—Bar 3-0-1/2-1 (evaporative yarn such as ASKIN)

FIG. 3D—Bar 4-1-0/1-2 (elastic yarn such as Spandex)

Preferably, bar 1 is a 50 Denier/24 filament fully drawn nylon yarn; bar 2 is a 75 Denier/36 filament conjugated polyester/nylon bi-component draw textured yarn; bar 3 is a 20 Denier/36 filament polyester draw textured yarn; and bar 4 is a 40 Denier spandex. This configuration results in a fabric having a density of 100-600 g/m$^2$, but more preferably 200-350 g/m$^2$. The combined multi-layer cooling fabric 100 resulting from this stitch is depicted in FIG. 3E.

The overall fiber content for this example is approximately 55% Polyester, 38% Polyamide, and 7% Elastane.

Furthermore, this example uses two additional finishing techniques. The first finishing technique used is brushing the surface on one side. After brushing the surface, the fabric is also embossed on the commercial face side of the material.

The yarn Deniers and filament counts used on bars 1-4 can be varied using the following ranges:

Bar 1: Evaporative yarn with Denier range—10 Denier-200 Denier, Filament range—1 filament-400 filaments Bar 2: Absorbent yarn with Denier range—10 Denier-200 Denier, Filament range—1 filament-400 filaments Bar 3: Evaporative yarn with Denier range—10 Denier-200 Denier, Filament range—1 filament-400 filaments Bar 4: Elastomeric yarn with Denier range—10 Denier-340 Denier Furthermore, the stitch notation for this example can vary from the above stated to the following:

Bar 1-1-0/3-4 (evaporative yarn such as ASKIN)

Bar 2-1-2/1-0 (absorbent yarn such as Nylon/Polyester Conjugated Yarn)

Bar 3-0-1/2-1 (evaporative yarn such as ASKIN)

Bar 4-1-0/1-2 (elastic yarn such as Spandex)

Additional Performance Yarn

An embodiment of the present invention is the use of other performance yarns to enhance evaporative and absorbency effects. Specifically, for the yarns listed in layers 104 and 108, other evaporative yarns with additional performance properties can be added, blended, or twisted with the evaporative yarns to intensify the cooling effect of fabric 100. Possible additional evaporative yarns include, but are not limited to, the following:

Mineral containing—An embodiment of the present invention involves incorporating yarns impregnated with various minerals such as mica, jade, coconut shell, volcanic ash, etc. These mineral containing yarns could be added to first layer 104 or third layer 108 to provide a cool touch and/or increased evaporative performance. Mineral yarn could be used to also provide greater surface area for added evaporation power. An example of this type of mineral containing yarn is 37.5 polyester or 37.5 nylon, both of which are manufactured by Cocona, Inc. Both of these example yarns contain particles permanently embedded at the fiber level which capture and release moisture vapor. The active particles provide approximately 800% more surface area to the fiber and also provide a unique driving force to remove moisture vapor. By actively responding to body heat, the active particles use this energy from the body to accelerate the vapor movement and speed up the conversion of liquid to vapor, significantly increasing drying rates. Using highly evaporative yarns allows for increase evaporation from the absorbent layers.

Absorbent yarns—An embodiment of the present invention includes the use of highly absorbent yarns such as bi-component synthetic, alternative modified cross-section synthetic yarn, cellulosic, and non-cellulosic blended yarns. This can include both filament and spun yarn and yarn combinations thereof which can be incorporated into layer 106. This also includes yarns described in U.S. Pat. No. 9,506,187 entitled "Textile Dyeing Using Nanocellulosic Fibers." Other absorbent yarns may include Nanofront polyester yarn manufactured by Teijin. For example, some Nanofront polyester filaments have a diameter of 400 nanometers, or 22500, times smaller than the cross-sectional area of a strand of hair.

Phase Change—Phase change yarns such as "Outlast" polyester and "Outlast" nylon, both of which are manufactures by Outlast Technologies LLC, can be incorporated into layer 106. Other cellulosic and non-cellulosic blended fibers as described above can be added to layer 106 the present invention to provide added cooling power and cooling touch.

Finishing Practices

In addition to normal textile finishing practices, an embodiment of the present invention includes applying extra finishing practices before or after construction of cooling fabric 100 which impart added cooling power, duration, temperatures and other cooling performance properties when the cooling fabric 100 is wetted to activate. The following provides examples of additional finishing practices suitable for use with cooling fabric 100. Combinations of the following methods may also be employed.

Burn out—Using a combination of yarns allows certain yarns to be chemically burned out of the material. This allows certain portions of the material to maintain a complete bundle of cooling yarns while other burned-out sections will not contain the complete bundle of cooling evaporative and absorbent yarns. This finishing method therefore allows for higher air transfer between burned out and non burned out sections, thereby adding to the evaporation rate and increased cooling ability. The burn-out finishing technique also allows for a mapping or patterns for areas of higher and lower cooling ability to be designed for a specific end-use. As an example, a yoga cooling towel will have a different burn out engineered burned-out pattering than a cooling shirt designed as a base layer under football pads.

Figure 4:
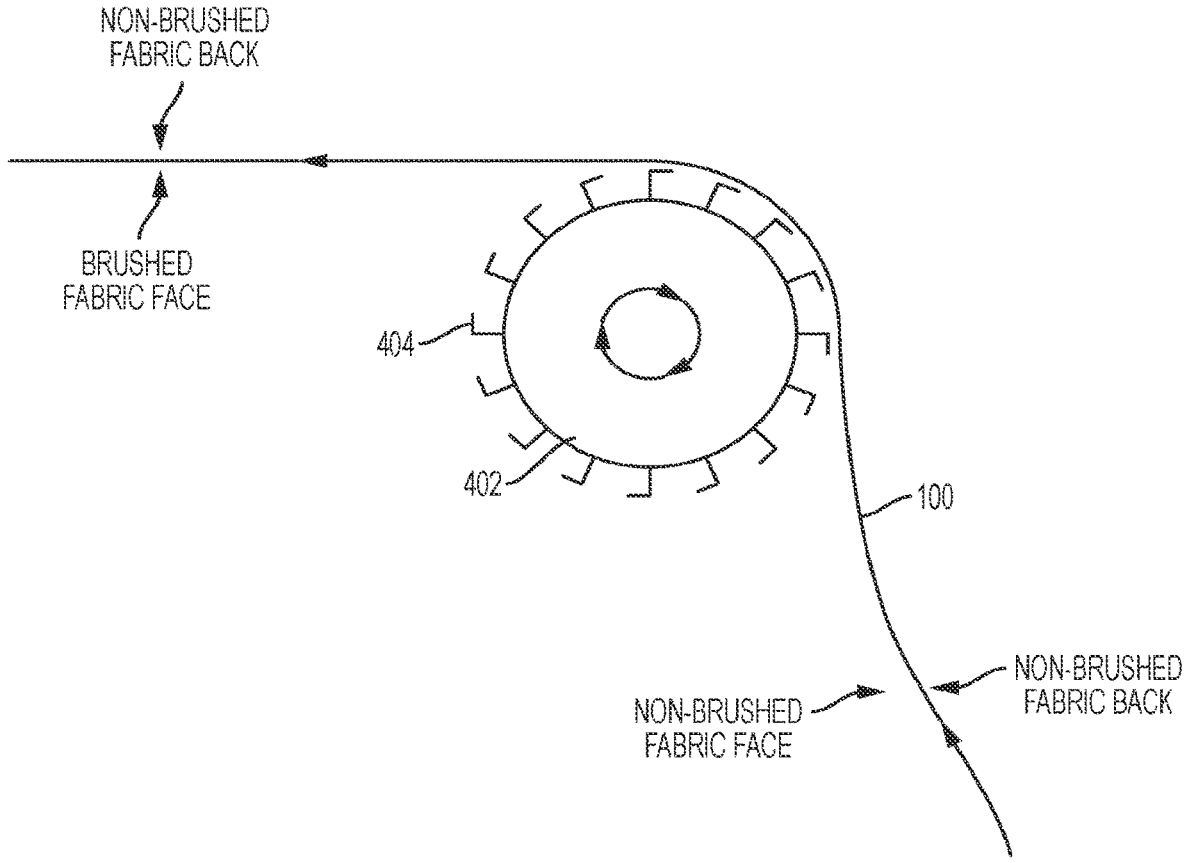
FIG. 4 depicts a brushing process.

Brushing and Shearing—Brushing, using methods such as pin brushing or less obtrusive ceramic paper brushing, provides pile height to the cooling fabric. This pile height provides a softer hand feel aesthetically and added absorbent ability. Additionally, added surface area for water evaporation helps speed the rate of evaporation. In addition to the pin brushing method, shearing the fabric surface to a select pile height or variable pile heights can create differential evaporation rates within the same textile. A diagram of a pin-type brushing machine is depicted in FIG. 4. As shown, one face of the cooling fabric 100 is fed over pin brusher 402 which rotates in a direction opposite to the direction that fabric 100 is fed. As cooling fabric 100 passes over pins 404, the pins slowly brush the surface of cooling fabric 100, leaving the back unscathed. In some embodiments, both sides of cooling fabric 100 can be brushed.

Figure 5:
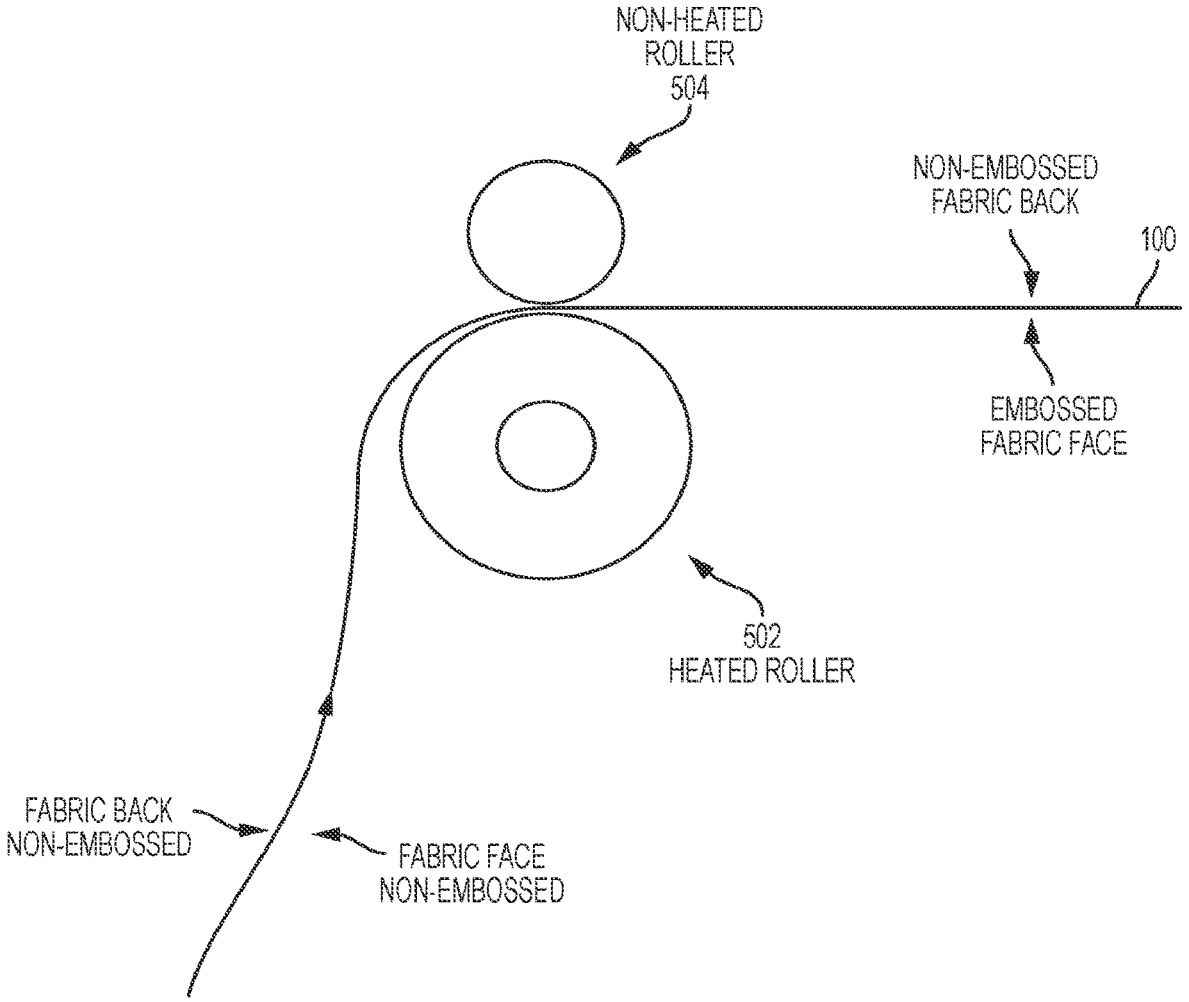
FIG. 5 depicts an embossing process.

Embossing—Embossing creates a reorientation of the fibers on the fabric surface. This finishing method is used to add surface area by flattening the yarn surface. This added surface area allows for a higher evaporation rate which thereby creates additional cooling properties and a higher level of evaporation. A diagram of an embossing machine and process is depicted in FIG. 5. Here, the cooling fabric 100 is fed between heated roller 502 and non-heated roller 504. The surface of heated roller 502 generally contains the pattern which is to appear on the final embossed fabric. In other embodiments, the fabric may be reversed if both sides of cooling fabric 100 are to be embossed.

Figure 6:
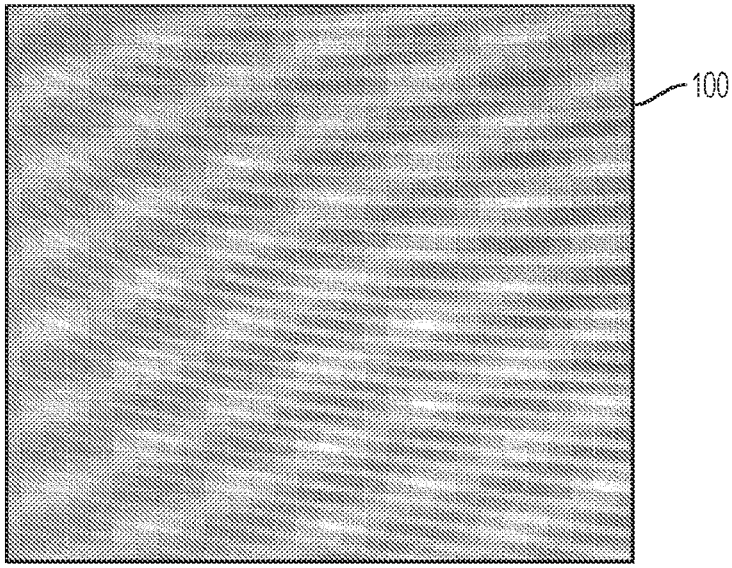
FIG. 6 depicts an image of a brushed and embossed cooling fabric.

Brushed+Embossed—Using a combination of brushing and embossing can impart added cooling properties to the cooling fabric. Brushing and Embossed performance benefits are both described above. A sample of textured cooling fabric 100 is depicted in FIG. 6 which has been both brushed and embossed.

Fabric Construction and Yarn Positions

A variety or combination of any of the following described constructions can impart added cooling power, duration, and lower temperatures when the cooling fabric is wetted to activate.

Yarn placement/position changes—The conjugate yarn used in layer 106 can also be used in other layers such as layer 104 (e.g., combined on bar 1, FIG. 3A) and combined with the evaporative yarn and spandex. This added yarn would provide more absorption power against the skin 102.

Warp knit pattern changes—The warp knit patterns described with respect to FIGS. 3A-3E can be modified while still producing a similar layering effect depicted in FIG. 1. For example, in FIG. 3A, bar 1—0/2-3 can be modified to 1/0-3/4.

Warp Knit Spacer—A similar layering effect depicted in FIG. 1 can also be achieved using a warp knit spacer. A warp knit spacer machine has the added capability of inserting additional yarns such as a mono-filament yarn to provided added thickness to the cooling fabric 100. This added thickness created by yarns such as mono-filament yarns can be substituted or combined intermittently with conjugate yarn while the outside yarns used can be highly evaporative yarns or previously described yarns.

Warp Knit Jacquard—A similar layering effect depicted in FIG. 1 can also be achieved using a warp knit jacquard. A warp knit jacquard can be utilized to create unique patterns such as but not limited to lace, fancy knits, mesh, body mapped, and other three-dimensional designs. Warp knit jacquard can creatively place highly evaporative yarns with highly absorbent yarns within the same construction to create a uniquely designed cooling fabric with or without patterns such as mesh and graphics.

Circular Knit Spacer—A similar layering effect depicted in FIG. 1 can also be achieved using a circular knit spacer. A circular knit spacer machine has the added capability of inserting additional yarns such as a mono-filament yarn to provided added thickness to the material. This added thickness created by yarns such as monofilament yarn can be substituted or combined intermittently with conjugate yarn while the outside yarns used can be highly evaporative yarns or any previously described yarns.

Circular Knit Interlock, Ponte', Pique—A similar layering effect depicted in FIG. 1 can also be achieved using a circular knit interlock, ponte, or pique constructions. A circular knit interlock machine has the added capability of inserting additional evaporative and absorbent yarns to provided added evaporative cooling ability to the fabric.

Circular Knit Jacquard—A similar layering effect depicted in FIG. 1 can also be achieved using a circular knit jacquard. A circular knit jacquard can be utilized to create unique patterns, such as, but not limited to, fancy knits, mesh, body-mapped patterns, and other three-dimensional designs. Circular knit jacquard can creatively place highly evaporative yarns with highly absorbent yarns within the same construction to create a uniquely designed cooling fabric with or without patterns such as mesh and graphics.

Flat bed knitting—A similar layering effect depicted in FIG. 1 can also be achieved using a flat knitting machine. A flat knitting machine is very flexible, allowing complex stitch designs, shaped knitting and precise width adjustment. The two largest manufacturers of industrial flat knitting machines are Stoll of Germany, and Shima Seiki of Japan.

Seamless and Hosiery Construction and Yarns

Figure 7A:
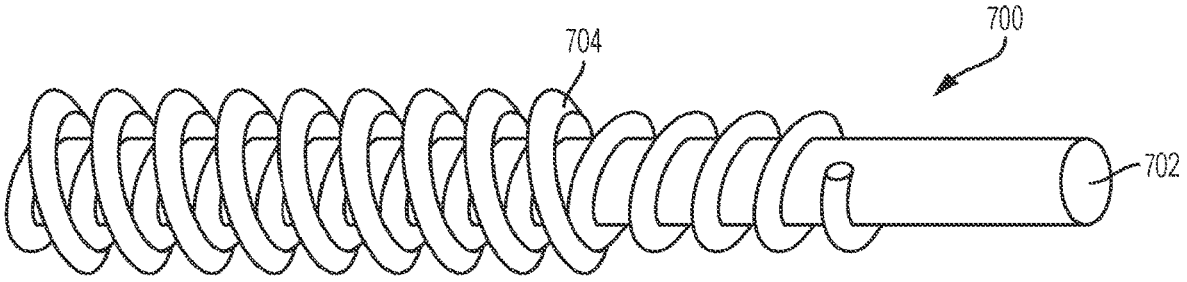
FIGS. 7A-7D depict yarns for use in seamless knitting constructions.
Figure 7B:
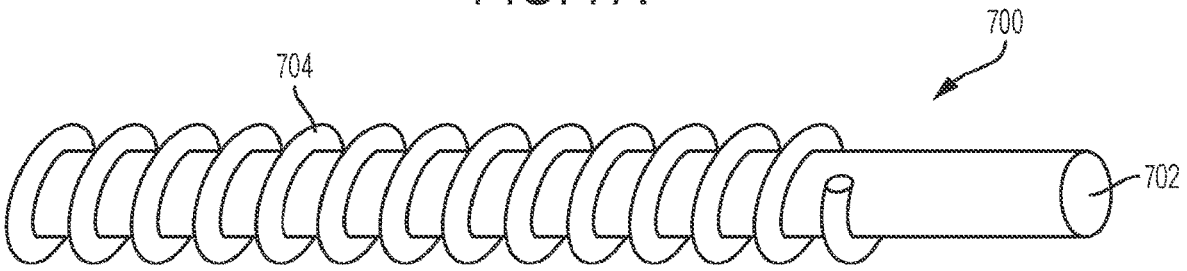

Seamless constructions require the use of a single yarn feed (which is typically a combination of nylon or polyester plus spandex) during construction. This single feed can be a single yarn or composed of multiple yarns during construction. In a first described embodiment, described is a multi-filament yarn construction that can be used in seamless constructions (e.g., for hosiery) that provides the same cooling effect as cooling fabric 100 described with reference to FIGS. 1-9. FIG. 7A illustrates a first yarn construction 700 compatible with seamless constructions. As shown, the core 702 of the yarn 700 is composed of multiple filaments of a stretchable yarn such as Lycra or spandex at various deniers. Additionally, the core 702 preferably comprises multiple filaments of a highly absorbent yarn such as that used in layer 106 of cooling fabric 100. Preferably, the absorbent yarn is a conjugated bi-component polyester and nylon yarn with having filaments with a special star-shaped cross-section as depicted in FIG. 3B.

The core 702 is either double covered (FIG. 7 A), single-covered (FIG. 7B), air jet covered (FIG. 7C), or corespun (FIG. 7D) by multiple filaments of evaporative yarn 704 such as that used in first layer 104. The evaporative yarn of covering 704 is preferably a nylon or polyester yarn having filaments with a unique cross-section (as seen in FIG. 2A) and is embedded with minerals (e.g., jade or mica) to transport and evaporate moisture from skin 102 to core 700 while still providing a cooling touch.

When yarn 700 is used in a seamless construction, the evaporative yarn, located in covering 704, rests against the skin of the user and it wicks moisture to the core 700. The moisture can then leave the fabric through covering 704 which is also exposed to the air (i.e., because it surrounds the core 700 on all sides). In this way, yarn 700 can be used to provide a similar layering effect to that of cooling fabric 100 depicted in FIG. 1.

Figure 8:
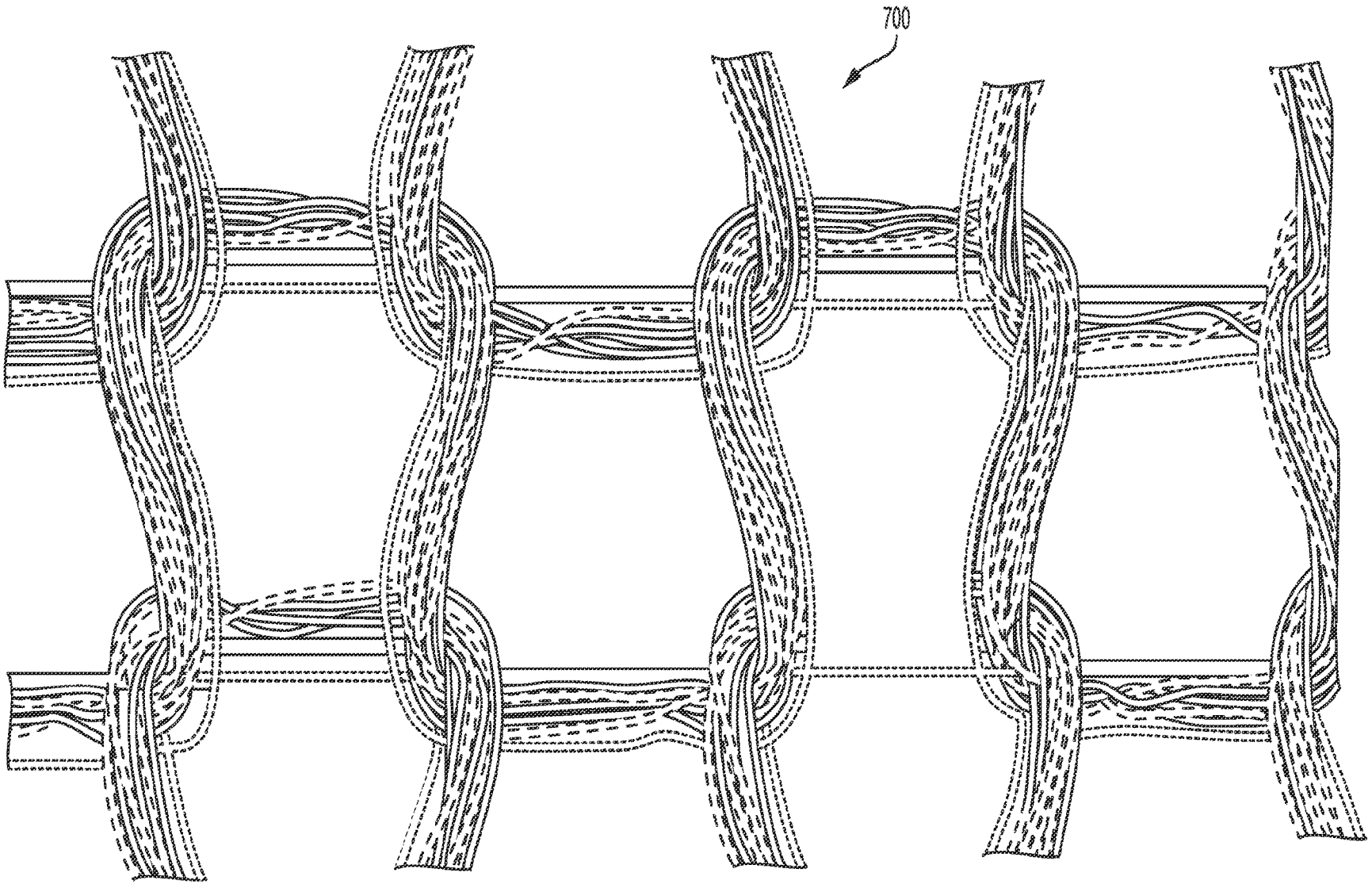
FIG. 8 depicts the yarns of FIGS. 7A-7D used in a seamless knit construction.
Figure 9A:
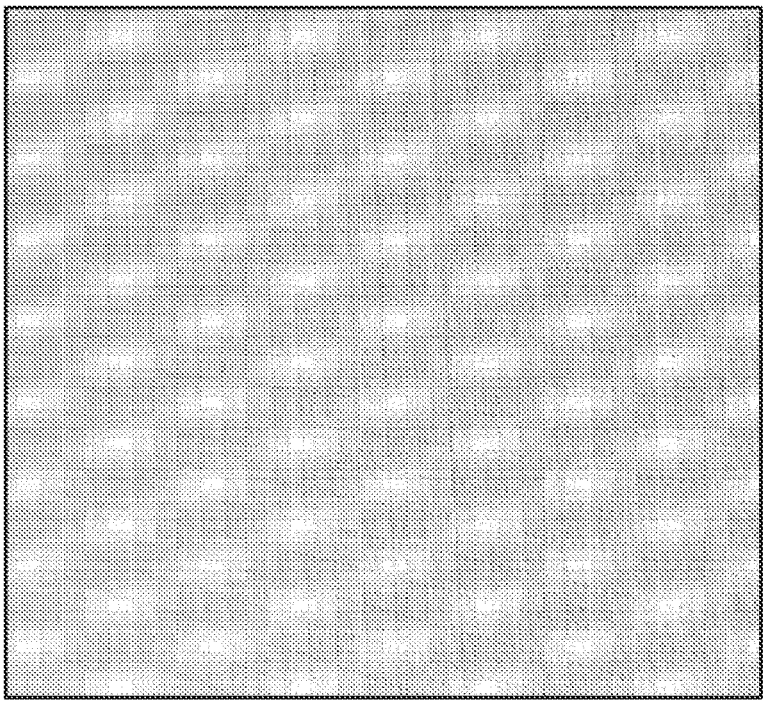
FIGS. 9A and 9B depicts faces and backs, respectively, of a seamless knit cooling fabric.
Figure 9B:
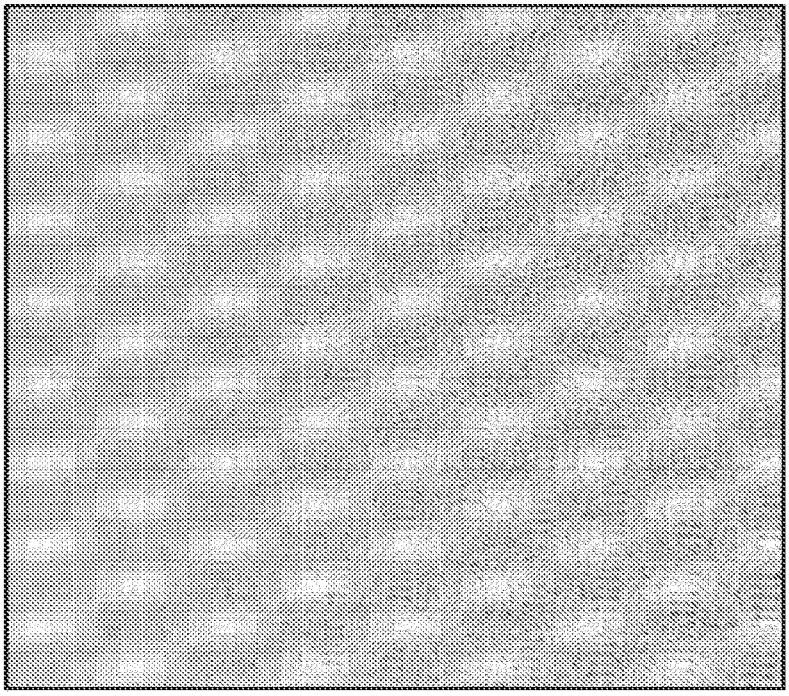

An example of a seamless knit construction utilizing yarn 700 is depicted in FIG. 8. FIG. 9A depicts a front face of a seamless knit fabric utilizing yarn 700 and FIG. 9B depicts a rear face of the same seamless knit fabric. As can be seen, the front and rear faces of the seamless knit fabric have different patterning. With seamless, patterns are easily altered and practically an unlimited amount of patterns are available.

Figure 7C:
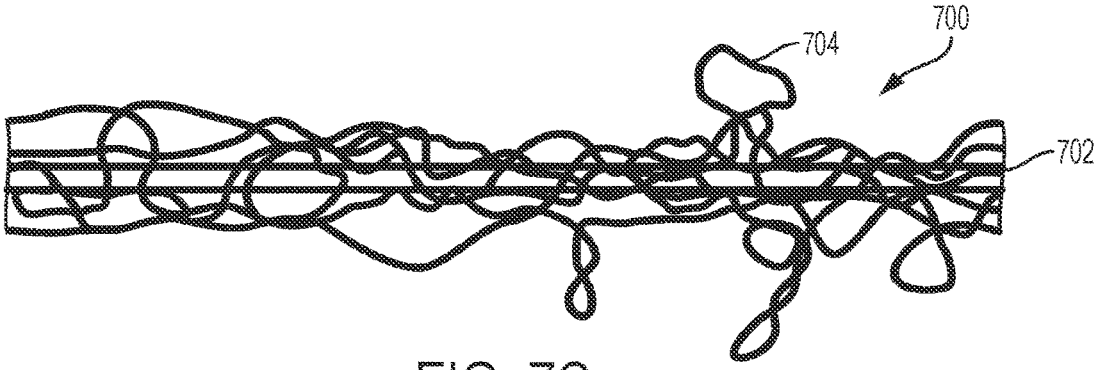
Figure 7D:
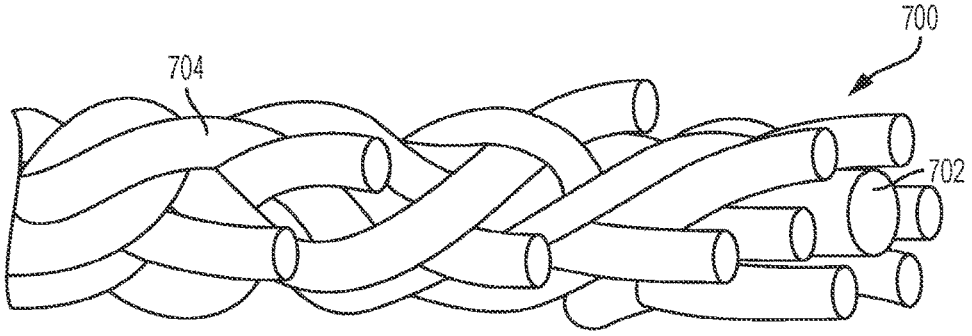

Other methods can also be used to form yarn 700 as depicted in FIGS. 7C and 7D. The yarn 700 depicted in FIG. 7C employs an air jet covering technique to cover core 702 (stretchable and absorbent yarns) with covering 704 (evaporative yarns). And, as depicted in FIG. 7D, the stretchable and absorbent yarns, are wrapped with evaporative yarns and core-spun into a single yarn 700 which can also be used in seamless knit constructions.

Seamless knit constructions have the advantage of being tubular and can be used to create unique patterns to impart added or lessened cooling zones within the material. The yarns shown in FIGS. 7 A-7D can also be used to create woven fabrics.

In other embodiments, the yarn used in the seamless or hosiery construction can be a single feed utilizing any combination of the yarns containing the filaments shown in FIGS. 2A-2D. For example, a first yarn used in the feed may be a combination of a highly absorbent yarn with a evaporative yarn and a second yarn may be a multiple filament spandex yarn In practical terms, the highly absorbent yarn can be plated separately into any seamless construction which also contains evaporative yarns to create a cooling material.

The present invention has been described with respect to various examples. Nevertheless, it is to be understood that various modifications may be made without departing from the spirit and scope of the invention as described by the following claims.

What is claimed is:

1. A multi-layered knitted cooling fabric, comprising:

a first layer formed of a first yarn;

a second layer formed of a second yarn; and a third layer formed of a third yarn;

wherein the first yarn includes a combination of an evaporative yarn and a stretchable synthetic yarn that form hydrophobic and hydrophilic channels, the second yarn includes an absorbent yarn, the third yarn includes an evaporative yarn adapted to allow moisture trapped in the second layer to move to the third layer, and the second layer is arranged between the first and third layers.

2. The multi-layered knitted cooling fabric according to claim 1, wherein the second layer is arranged adjacent the first layer.

3. The multi-layered knitted cooling fabric according to claim 1, wherein the third layer is arranged adjacent the second layer.

4. The multi-layered knitted cooling fabric according to claim 2, wherein the third layer is arranged adjacent the second layer.

5. The multi-layered knitted cooling fabric according to claim 1, wherein the first yarn includes an evaporative and UV-protective yarn.

6. The multi-layered knitted cooling fabric according to claim 1, wherein the second yarn includes a conjugated bi-component polyester and nylon yarn.

7. The multi-layered knitted cooling fabric according to claim 1, wherein the second yarn has a wicking rate and a wicking distance more than twice that of cotton of equivalent density.

8. The multi-layered knitted cooling fabric according to claim 1, wherein the third yarn includes an evaporative and UV-protective yarn.

9. The multi-layered knitted cooling fabric according to claim 1, wherein the multi-layered knit cooling fabric has a density of 100 to 600 $g/m^2$.

10. The multi-layered knitted cooling fabric according to claim 1, wherein the first layer includes spandex.

11. The multi-layered knitted cooling fabric according to claim 1, wherein the first yarn includes a conjugated bi-component polyester and nylon yarn with a star-shaped cross-section.

12. The multi-layered knitted cooling fabric according to claim 1, wherein the fabric forms an entire garment.

13. The multi-layered knitted cooling fabric according to claim 1, wherein the garment includes a shirt, pants, and/or shorts.

14. The multi-layered knitted cooling fabric according to claim 1, wherein the fabric is integrated into a garment.

15. The multi-layered knitted cooling fabric according to claim 1, wherein the multi-layered knitted cooling fabric forms a headband, a towel, and/or a hat.

16. The multi-layered knitted cooling fabric according to claim 1, wherein the first layer is adapted to be worn against skin.

17. The multi-layered knitted cooling fabric according to claim 1, wherein the third layer is adapted to be exposed to an external environment.

18. The multi-layered knitted cooling fabric according to claim 1, wherein the evaporative yarn of the first yarn includes an embedded mineral adapted to transport and evaporate moisture.

19. The multi-layered knitted cooling fabric according to claim 18, wherein the mineral includes jade and/or mica.

20. The multi-layered knitted cooling fabric according to claim 1, wherein the evaporative yarn of the first yarn includes a covered yarn.

* * * * *